United States Patent [19]

Gordon

[11] Patent Number: 4,891,666

[45] Date of Patent: Jan. 2, 1990

[54] COPY INDICATOR FOR A DOCUMENT

[75] Inventor: Douglas C. Gordon, Kinburn, Canada

[73] Assignee: Quebecor Publitech Inc., Toronto, Canada

[21] Appl. No.: 276,895

[22] Filed: Nov. 28, 1988

[51] Int. Cl.[4] ..... B42D 15/00

[52] U.S. Cl. ..... 355/133; 283/72; 355/201

[58] Field of Search ..... 355/133, 201; 283/72, 283/901, 902, 73, 74, 94

[56] References Cited

U.S. PATENT DOCUMENTS

| | | | |
|---|---|---|---|
| 3,126,647 | 3/1964 | Hazelett | 283/72 X |
| 4,168,088 | 9/1979 | Somlyody | 283/902 |
| 4,175,774 | 11/1979 | Tonges et al. | 283/94 |
| 4,227,719 | 10/1980 | McElligott et al. | 283/94 X |
| 4,265,469 | 5/1981 | Mowrey, Jr. et al. | 355/133 X |
| 4,303,307 | 12/1981 | Turek et al. | 283/72 X |
| 4,310,180 | 1/1982 | Mowrey, Jr. et al. | 355/133 X |
| 4,456,373 | 6/1984 | Best | 283/72 X |
| 4,459,020 | 7/1984 | May et al. | 355/133 X |
| 4,582,346 | 4/1986 | Caprio et al. | 355/133 X |

*Primary Examiner*—Richard A. Wintercorn
*Attorney, Agent, or Firm*—Ridout & Maybee

[57] ABSTRACT

A printed background pattern for a document is described, wherein the pattern masks a copy indicator which is revealed upon making a copy of the pattern using a digital optical scanning means. The background pattern comprises an area of microprinting with a type size having a line resolution of about 20% to about 80% of the resolving power of the scanning means. Preferably, the type size is less than 100 μm. An area of solid line printing is provided within the microprinting which defines the copy indicator. The solid lines have a visual value approximating that of the microprinting so as to be masked therein, and the solid lines are capable of resolution by the digital scanning means.

9 Claims, 2 Drawing Sheets

COPY INDICATOR FOR A DOCUMENT

The invention relates to means for securing documents against unwanted photocopying. The invention is a printed background pattern for a document having a copy indicator which is masked by microprinting so that the indicator, but not the microprinting, is reproduced upon photocopying of the document. The invention is particularly directed to photocopies made using a digital laser xerographic colour copier, but has general application for thwarting the production of copies through the use of high resolution digital scanning means.

With the advent of digital laser xerographic colour copiers, it has become possible to make high quality copies of colour printed documents which are virtually indistinguishable from the original. The performance capability of these copiers has caused concern for the security of sensitive documents against unauthorized copying or counterfeiting. Thus, while the principles of the present invention are applicable with relation to all types of xerographic copiers, the invention is particularly useful for copies made using these new digital laser machines. The invention has application in respect of the reproduction of a document using any apparatus which employs high resolution digital scanning means. In addition to xerographic copiers such scanning means are found in colour separation machines used in printing. A colour separator having a high resolution digital scanner is used to break down a document into three or four films each for a different colour. The original image is reconstructed by printing the colour separated films on top of one another.

The ability of the new digital laser colour xerographic copiers to make high quality copies is, in part, due to the high resolving power of the copier's digital optical scanner. Typically, this resolving power is about 0.0015 inches or about 38 μm for the detection of a solid horizontal line. Since the letter E consists of five horizontal lines, i.e. three inked lines spaced by two non-inked lines, the theoretical limit for lettering, numerals and other symbols requiring up to five lines of resolution would be about 0.0075 inches or 190 μm. Thus, if it were possible to create a pattern of printed symbols, e.g. lettering, on a document such that the individual symbols comprising the printed pattern were outside the resolving power of the copier's scanner, it would not be possible to copy the pattern. Rather, the printed pattern would not be reproduced at all or would be reproduced as a smudge.

While this approach to the problem of unauthorized copying was theoretically attractive, it was not known if sufficiently small printed symbols could be obtained, and further, even if such microprinting were achieved, the desired visual impact was uncertain. Since microprinting with letter size on the order of 100–200 μm is impossible to read without a magnifier, it may be possible to pass off a copy having a smudged microprinted portion for a genuine document, the differences between the original and copy not being immediately obvious to the unaided eye. Also, if the desired microprinting were obtainable using known standard graphic arts equipment and techniques, the security background pattern might be too easily counterfeited by making photolithographic copies.

The present invention addresses these issues by providing an indicator which is masked within a pattern of microprinting so that upon xerographic copying of the pattern, the indicator is reproduced but the microprinting is not. The indicator may be a word such as "VOID" or "COPY" or some other clear indication that the document is suspect. The indicator is defined by a plurality of solid lines each of which is within the resolving power of the copier's scanner. Preferably, the solid lines conform to the line shape of the surrounding microprinting and have a visual value approximating that of the microprinting. These preferred features enhance the invisibility of the indicator to the unaided eye, and thus, provide a very marked and obvious difference between the original and xerographic copy of the document. The background pattern comprises microprinting of a size which is incapable of reproduction or duplication using standard graphic arts cameras, film and related equipment.

While the foregoing is thought to represent a logical approach to the development of an anti-copy indicator for a document, the extreme resolving power of the latest generation of digital laser copiers required the printing of symbols for masking the copy indicator which were on the order of 40–150 μm type size. A type size of less than 100 μm is not generally possible using graphic arts cameras, film and related equipment, and also, a type size of less than 100 μm was felt to be preferred because the masking effect is optimized to the unaided eye as the type and line sizes are reduced. While, it was known that a type size of less than 100 μm could not be reproduced photolithographically, it was not known if a photographic negative bearing the desired type size were made, whether such a small size could be printed at all.

Solutions to these problems have been found. A legible lettering type sized at 50 μm has been obtained using reduction equipment and techniques utilized in the microelectronics art, and it has been shown that such a type size can be photolithographically printed using standard, albeit careful, printing techniques. By utilizing the masking theory of the invention, an indicator may be hidden in such microprinting, so that with proper use of colour and visual density, the indicator may be made virtually indistinguishable to the unaided eye from the surrounding microprinting. However, upon copying using even the most sophisticated digital laser copier presently available, the microprinting is not reproduced whereas the indicator is reproduced.

Accordingly, the invention provides a printed background pattern for a document having masked within the pattern a copy indicator which is revealed upon making a copy of the document using an apparatus having high resolution digital optical scanning means. The printed background pattern comprises an area of symbol microprinting having a line resolution of between about 20% and about 80% of the line resolving power of the digital scanning means. An area of solid line printing is provided within the area of symbol microprinting, wherein a plurality of solid lines are arranged to define the copy indicator. The solid lines have a visual value approximating that of the microprinting so that the indicator defined by the lines is masked by the microprinting, the solid line printing being capable of resolution by the digital scanning means.

BRIEF DESCRIPTION OF THE DRAWINGS

The invention comprises a microprinted pattern 10 which, to the unaided eye, appears to be an area of shading in the printed document. FIG. 1 illustrates this shading effect which is apparent even on a several fold magnification of the microprinted pattern. The microprinted pattern is further enlarged in FIG. 2 to reveal the individual letters 12 of the printing.

As shown in FIG. 2, a printed background pattern 10 of symbols, which may be letters, numbers or other symbols, is created which is then provided with spaces 14 therein for the copy indicator, which is in this case the word "VOID" (FIG. 3). The lines of printing can be straight or wavy depending on the visual effect the document maker intends. In order for the printed symbols to be unreproducible by a state of the art digital optical scanner, the symbols used must possess a plurality of lines so that each line has a resolution which is in the range of about 20% to about 80% of the line resolving power of the digital scanner. The symbols should be sanserif for greater legibility upon photolithographic printing of the greatly reduced type size.

As shown in FIG. 4, the copy indicator "VOID" 16 is provided as a plurality of solid lines 17 which are capable of being resolved by the digital scanning means of a copier or other document reproduction apparatus. The lines 17 of the copy indicator 16 are printed to have a visual value approximating that of the microprinted background 10, thereby being masked within the background 10. This masking effect is not particularly evident from FIG. 4 which is illustrative only, but as the skilled person will appreciate, the visual masking of the indicator 16 within the microprinting 10 is readily achieved upon microreduction and adjustment of the visual values of the components. The use of colour printing techniques is also extremely useful in producing virtually a perfectly masked copy indicator 16 within the microprinted background 10.

Figure 1:
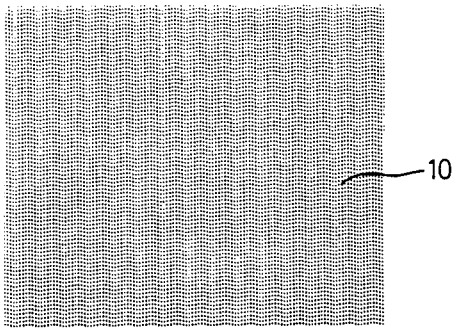
FIG. 1 is an enlargement of a suitable printing pattern comprising the background pattern of the invention, where the enlargement is not sufficient to render the printing legible to the unaided eye.
Figure 2:
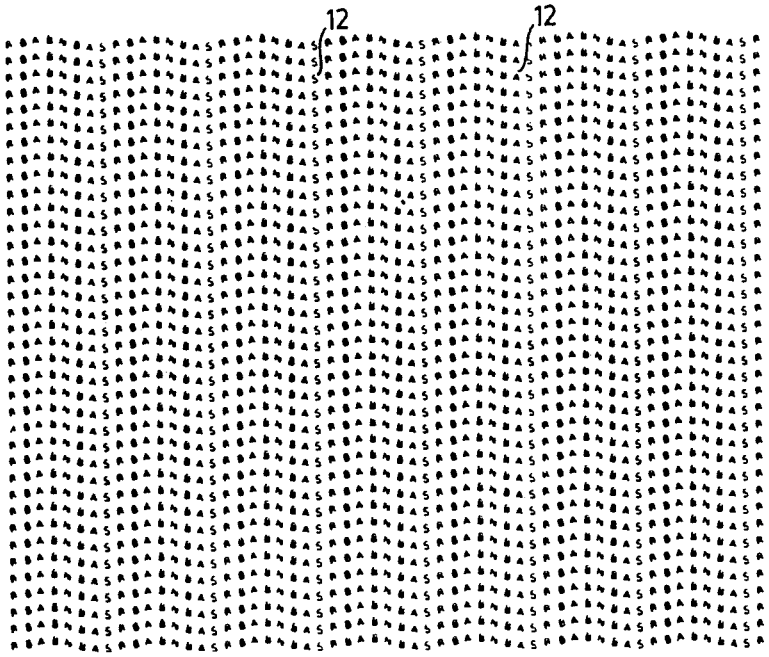
FIG. 2 is a further enlargement of the pattern in FIG. 1 rendering the printing legible to the unaided eye.
Figure 3:
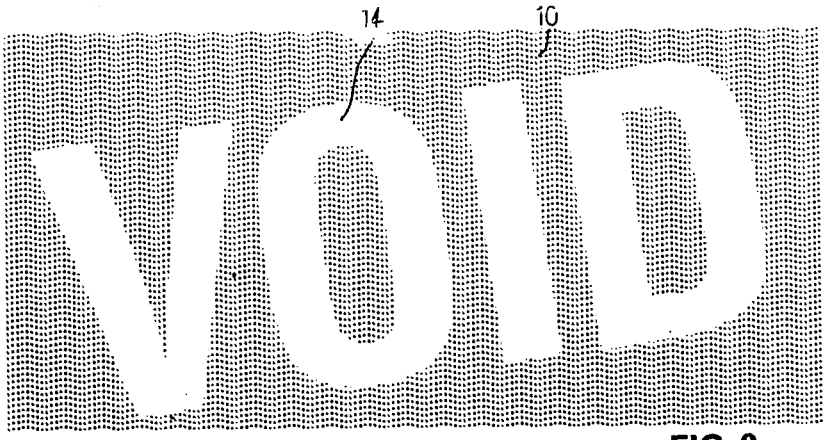
FIG. 3 is an enlargement showing a printing pattern with spaces for a copy indicator.
Figure 4:
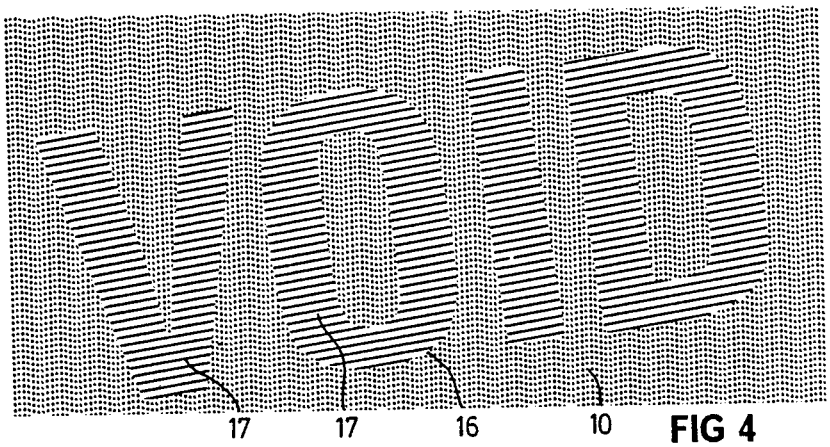
FIG. 4 is an enlargement showing the solid lined copy indicator in the background printing.

The process for creating a pattern 10 of printed symbols and lined areas 16 as shown in FIG. 4 is well known to those skilled in the art. The reduction of a pattern as shown in FIG. 4 to a type size of 200–250 μm can also be readily achieved by the skilled person using standard graphic arts equipment and film. Reduction below 150 μm is difficult to achieve with regular graphic arts equipment, and it requires extremely careful work to obtain a barely legible printing of a 100 μm sanserif all capitals type.

In order to prevent counterfeiting of the background pattern 10 having the masked copy indicator 16 through the use of readily available graphic arts equipment, it is necessary to be able to produce a symbol microprinting having a type size smaller than 100 μm. The present invention provides such a microprinting wherein a legible text is obtained for a 50 μm type size as photolithographically printed. The preferred type size is 70 μm since this size is more easily printed and provides uniformly well formed and legible symbol reproduction.

The photoreduction of the pattern of FIG. 4 is accomplished using techniques and equipment used in the microelectronics art. The cameras, film and related equipment used in this field are not readily available to the graphic arts technician and are extremely expensive. The equipment is, however, well established in the microelectronics art, the initial prototypes of the present invention being carried out with equipment which was 15 to 20 years old.

Once a negative was produced having the microprinted pattern 10 of FIG. 4 with a 50 μm to 70 μm type size, it was not apparent that the type could be satisfactorily printed photolithographically. However, surprisingly, it was found that such microprinting could be photolithographically printed using standard materials and equipment. The printing technician must use good equipment and materials and must work carefully to ensure the best results, but the printing process from the negative of the microprinted pattern has been shown to be a routine matter.

From the foregoing, it will be appreciated that under ideal conditions of coated stock, careful plate making and press set up, it is possible to print legibly sanserif all capitals type having five lines of resolution with the letter E being 50 μm high. This capability allows one to produce a background pattern 10 for a document having masked within the pattern a copy indicator 16 which is revealed upon making a copy of the document using a digital optical scanner such as that now available in digital laser xerographic colour copiers. The microprinted background 10 has a line resolution of between about 20% and about 80% of the line resolving power of the digital scanner. Preferably, the symbols forming the microprinting are less than 100 μm in size so as to be not reproducible by standard graphic arts equipment and materials. The copy indicator 16 masked within the background pattern 10 of microprinting comprises a plurality of solid lines 17 which are individually capable of resolution by the digital scanning means of the copier or other reproduction apparatus, but which have a visual value approximating that of the microprinting 10 so as to be masked thereby.

Figure 5:
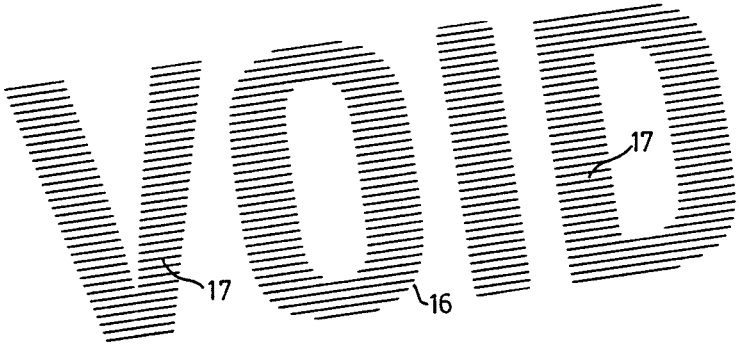
FIG. 5 is an enlargement of the effect obtained when the microprinted background containing the masked indicator is copied using digital scanning means.

When an attempt is made to copy the printed background 10 using a digital laser copier or the like, the microprinting 10 is not reproduced since it cannot be resolved by the scanning means of the apparatus, but the copy indicator 16 is resolved and printed resulting in a copy as shown in FIG. 5 (greatly enlarged for illustration).

I claim:

1. A printed background pattern for a document having masked within the pattern a copy indicator which is revealed upon making a copy of the document using an apparatus having high resolution digital optical scanning means, the printed background pattern comprising:

an area of symbol microprinting having a line resolution of between about 20% and about 80% of the line resolving power of the digital scanning means; and an area of solid line printing within the area of symbol microprinting, wherein a plurality of solid lines are arranged to define the copy indicator, the solid lines having a visual value approximating that of the microprinting so that the indicator defined by the lines is masked by the microprinting, the solid line printing being capable of resolution by the digital scanning means.

2. A printed background pattern as claimed in claim 1, wherein the symbols comprise a plurality of resolvable lines.

3. A printed background pattern as claimed in claim 1, wherein the symbols are each between about 30 μm and about 100 μm in size.

4. A printed background pattern as claimed in claim 1, wherein the symbols are each between about 50 μm and about 80 μm in size.

5. A printed background pattern as claimed in claim 1, wherein the symbols are each about 70 μm in size.

6. A printed background pattern as claimed in claim 1, wherein the symbols are sanserif.

7. A printed background pattern as claimed in claim 1, wherein the microprinting and copy indicator are printed in colour.

8. A printed background pattern as claimed in claim 1, wherein the copying apparatus is a digital laser xerographic colour copier.

9. A printed background pattern as claimed in claim 1, wherein the copying apparatus is a digital colour separation apparatus.

* * * * *